US009257087B2

(12) United States Patent
Chen

(10) Patent No.: US 9,257,087 B2
(45) Date of Patent: Feb. 9, 2016

(54) DISPLAY DEVICES AND PIXEL DRIVING METHODS THEREFOR

(71) Applicant: INNOLUX CORPORATION, Chun-Nan, Miao-Li County (TW)

(72) Inventor: Chien-Hung Chen, Chu-Nan (TW)

(73) Assignee: INNOLUX CORPORATION, Chu-Nan (TW)

( * ) Notice: Subject to any disclaimer, the term of this patent is extended or adjusted under 35 U.S.C. 154(b) by 411 days.

(21) Appl. No.: 13/794,695

(22) Filed: Mar. 11, 2013

(65) Prior Publication Data

US 2013/0307836 A1 Nov. 21, 2013

(30) Foreign Application Priority Data

May 16, 2012 (TW) ..... 101117314 A

(51) Int. Cl.
*G09G 3/36* (2006.01)

(52) U.S. Cl.
CPC ..... *G09G 3/3696* (2013.01); *G09G 3/3648* (2013.01); *G09G 3/3659* (2013.01)

(58) Field of Classification Search
CPC .. G09G 3/3696; G09G 3/3659; G09G 3/3648
See application file for complete search history.

(56) References Cited

U.S. PATENT DOCUMENTS

| | | | | |
|---|---|---|---|---|
| 7,864,149 | B2 * | 1/2011 | Do et al. | 345/92 |
| 8,786,531 | B2 * | 7/2014 | Yamauchi | 345/90 |
| 2011/0122355 | A1 * | 5/2011 | Matsumuro et al. | 349/143 |

FOREIGN PATENT DOCUMENTS

| | | |
|---|---|---|
| TW | 200905646 | 2/2009 |

* cited by examiner

*Primary Examiner* — Abbas Abdulselam
(74) *Attorney, Agent, or Firm* — Liu & Liu

(57) ABSTRACT

A display device is provided. The display device includes a pixel driving circuit including a liquid crystal capacitor coupled to a first node, a first storage capacitor, and a first voltage control unit. The first storage capacitor has a first terminal directly connected to a second node and a second terminal coupled to a common electrode. The first voltage control unit has first and second output terminals coupled to the first and second nodes, respectively. In a first period, the first voltage control unit feeds a first data voltage to the first node according to a first scan signal. In a second period later than the first period, the first voltage control unit feeds the first data voltage to the second node according to a second scan signal, such that a voltage level at the first node is changed to a first pixel voltage from the first data voltage.

17 Claims, 10 Drawing Sheets

DISPLAY DEVICES AND PIXEL DRIVING METHODS THEREFOR

CROSS REFERENCE TO RELATED APPLICATIONS

This Application claims priority of Taiwan Patent Application No. 101117314, filed on May 16, 2012, the entirety of which is incorporated by reference herein.

BACKGROUND OF THE INVENTION

1. Field of the Invention

The invention relates to a display device, and more particularly to a pixel driving circuit.

2. Description of the Related Art

A liquid crystal display (LCD) device comprises a first substrate, a second substrate opposite to the first substrate, and a liquid crystal layer between the first substrate and the second substrate. The first substrate comprises a first pixel electrode and a second pixel electrode which are isolated from each other and disposed on the same plane. The first pixel voltage is applied to the first pixel electrode, and the second pixel voltage is applied to the second pixel electrode. The second pixel voltage is different from the first pixel voltage.

The first pixel voltage and the second pixel voltage are usually generated by a first data voltage and a second data voltage, respectively. However, the levels of the first data voltage and the second data voltage may suffer certain limits. Thus, it is desirable to provide a display device and a pixel driving method for increasing the voltage difference between the first pixel electrode and the second pixel electrode.

BRIEF SUMMARY OF THE INVENTION

An exemplary embodiment of a display device is provided. The display device comprises a pixel driving circuit. The pixel driving circuit comprises a liquid crystal capacitor, a first storage capacitor, and a first voltage control unit. The liquid crystal capacitor is coupled to a first node. The first storage capacitor has a first terminal directly connected to a second node and a second terminal coupled to a common electrode. The first voltage control unit has a first output terminal and a second output terminal coupled to the first node and the second node, respectively. In a first period, the first voltage control unit feeds a first data voltage to the first node according to a first scan signal. In a second period later than the first period, the first voltage control unit feeds the first data voltage to the second node according to a second scan signal, such that a voltage level at the first node is changed to a first pixel voltage from the first data voltage.

An exemplary embodiment of a display device is provided. The display device comprises a pixel driving circuit. The pixel driving circuit comprises a liquid crystal capacitor, a first storage capacitor, a third storage capacitor, a first voltage control unit, and a second voltage control unit. The liquid crystal capacitor is coupled between a first node and a third node. The first storage capacitor has a first terminal directly connected to a second node and a second terminal coupled to a common electrode. The third storage capacitor has a first terminal directly connected to a fourth node and a second node coupled to the common electrode. The first voltage control circuit has a first output terminal and a second output terminal coupled to the first node and the second node, respectively. The second voltage control circuit has a first terminal and a second terminal coupled to the third node and the fourth node, respectively. In a first period, the first voltage control unit and the second voltage control unit feed a first data voltage and a second data voltage to the first node and the third node, respectively, according to a first scan signal. In a second period later than the first period, the first voltage control unit and the second voltage control unit feed the first data voltage and the second data voltage to the second node and the fourth node, respectively, according to a second scan signal, such that a voltage level at the first node is increased to a first pixel voltage from the first data voltage and a voltage level at the second node is decreased to a second pixel voltage from the second data voltage.

An exemplary embodiment of a pixel driving method is provided. The pixel driving method is applied to a pixel driving circuit of a display device. The pixel driving comprises a step of, in a first period, feeding a first data voltage to a first node, which is coupled to a liquid crystal capacitor, according to a first scan signal. A first storage capacitor is directly connected between a second node and a common electrode, and a second storage capacitor is directly connected between the first node and the second node. The pixel driving further comprises a step of, in a second period later than the first period, feeding the first data voltage to the second node according to a second scan signal, such that a voltage level at the first node is coupled to a first pixel voltage from the first data voltage by the first storage capacitor, the second storage capacitor, and the liquid crystal capacitor.

An exemplary embodiment of a display device is further provided. The display device comprises a pixel driving circuit. The pixel driving circuit comprises a liquid crystal capacitor, a first storage capacitor, a second storage capacitor, a first voltage control unit, and a second voltage control unit. The liquid crystal capacitor is coupled between a first node and a second node. The first storage capacitor has a first terminal directly connected to the first node and a second terminal coupled to a common electrode. The second storage capacitor has a first terminal directly connected to the second node and a second terminal coupled to the common electrode. The first voltage control unit has a first output terminal and a second output terminal coupled to the first node and a third node, respectively. The second voltage control unit has a first output terminal and a second output terminal coupled to the second node and a fourth node, respectively. In a first period, the first voltage control unit feeds a first data voltage to the first node and the third node according to a first scan signal, and the second voltage control unit feeds a second data voltage to the second node and the fourth node according to the first scan signal. In a second period later than the first period, the first voltage control unit and the second voltage control unit feed the first data voltage and the second data voltage to the fourth node and third node according to a second scan signal, respectively, such that a voltage level at the first node is increased to a first pixel voltage from the first data voltage, and a voltage level at the second node is decreased to a second pixel voltage from the second data voltage.

An exemplary embodiment of a pixel driving method is further provided. The pixel driving method is applied to a pixel driving circuit of a display device. The pixel driving method comprises a step of, in a first period, feeding a first data voltage to a first node, which is coupled to the liquid crystal capacitor, and to a third node, which is coupled to a second voltage control unit, according to a first scan signal and feeding a second data voltage to a second node, which is coupled to the liquid crystal capacitor, and to a fourth node, which is coupled to a first voltage control unit, according to the first scan signal. A first storage capacitor is directly connected between the first node and a common electrode, and a second storage capacitor is directly connected between the second node and the common electrode. The pixel driving method further comprises a step of, in a second period later than the first period, feeding the first data voltage to the fourth node according to a second scan signal and feeding the second data voltage to the third node according to the second scan line, such that a voltage level at the first node is increased to a first pixel voltage from the first data voltage, and a voltage level at the second node is decreased to a second pixel voltage from the second data voltage.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
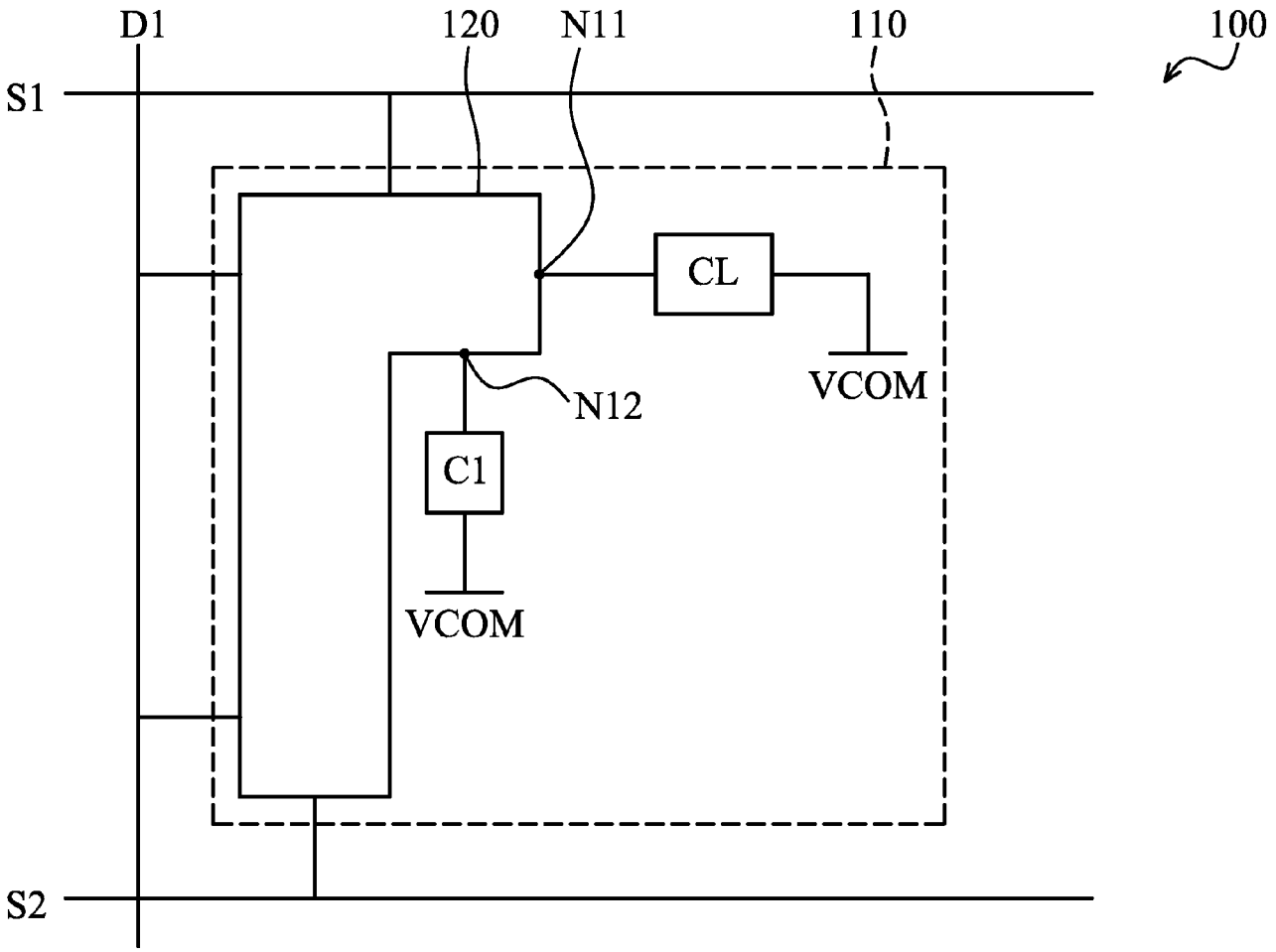
FIG. 1 shows an exemplary embodiment of a display device.

Display devices are provided. In an exemplary embodiment of a display device 100 in FIG. 1, a display device 100 comprises a pixel driving circuit 110 coupled to a first data signal line D1, a first scan signal line S1, and a second scan signal line S2. The pixel driving circuit 110 comprises a liquid crystal capacitor CL, a storage capacitor C1, and a first voltage control unit 120. In detailed, a first terminal of the liquid crystal capacitor CL is coupled to a first node N11, and a second terminal thereof is coupled to a common electrode VCOM. The storage capacitor C1 has a first terminal which is directly connected to a second node N12 and a second terminal which is coupled to the common electrode VCOM. The first voltage control unit 120 has a first output terminal and a second output terminal which are coupled to the first node N11 and the second node N12, respectively.

In a first period P1, the first voltage control unit 120 feeds a first data voltage to the first node N11 according to a first scan signal. In a second period P2 later than the first period P1, the first voltage control unit 120 feeds the first data voltage to the second node N12 according to a second scan signal, such that the voltage level at the first node N11 is increased to a first pixel voltage from the first data voltage.

Figure 2:
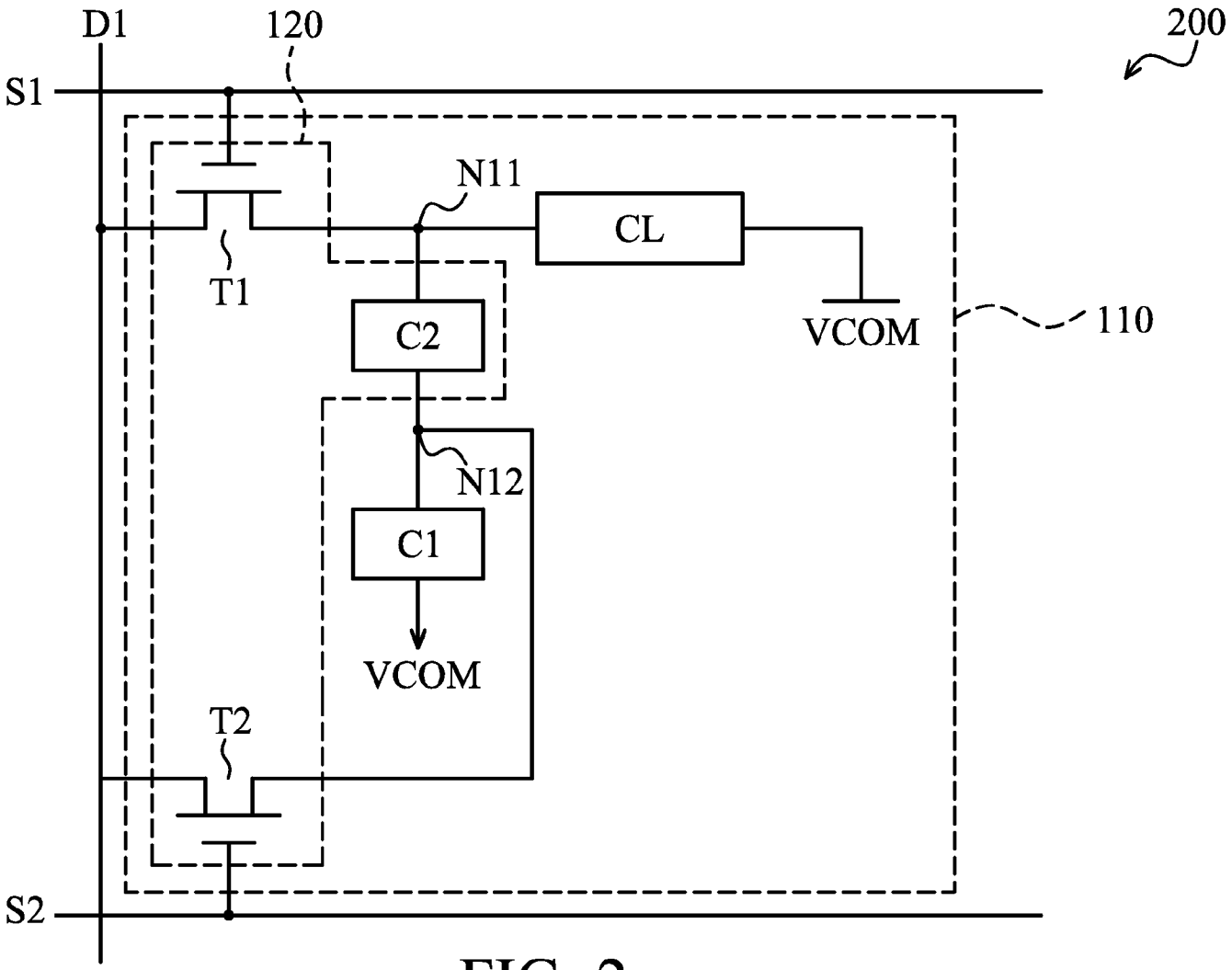
FIG. 2 shows an exemplary embodiment of a pixel driving circuit.

FIG. 2 shows an exemplary embodiment of the pixel driving circuit. As shown in FIG. 2, a display device 200 is the same as the display device 100. The first voltage control unit 120 comprises switch elements T1 and T2 and a storage capacitor C2. In detail, the switch element T1 comprises a first terminal which is coupled to the first node N11, a second terminal which is coupled to the first data signal line D1 used for outputting the first data voltage, and a control terminal which is coupled to the first scan signal line S1 used for outputting the first scan signal. The switch element T2 comprises a first terminal which is coupled to the second node N12, a second terminal which is coupled to the first data signal line D1, and a control terminal which is coupled to the second scan signal line S2 used for outputting the second scan signal. The storage capacitor C2 is coupled between the first node N11 and the second node N12.

In the first period P1, the switch element T1 is turned on according to the first scan signal, while the switch element T2 is turned off according to the second scan signal, such that the switch element T1 feeds the first data voltage to the first node N11. In the second period P2, the switch element T1 is turned off according to the first scan signal, while the switch element T2 is turned on according to the second scan signal, such that the switch element T2 feeds the first data voltage to the second node N12. Accordingly, the voltage level at the first node N11 is changed to the first pixel voltage (effective coupling) by the variations of the voltage of the storage capacitor C2 and the voltage at the second node N12.

For example, it is assumed that the voltage level of the first data voltage is VD1. In the first period P1, the voltage level at the first node N11 is VD1, and the voltage level at the second node N12 is $$VD1\frac{\frac{1}{C1}}{\frac{1}{C2}+\frac{1}{C1}}=VD1\frac{1}{1+\frac{C1}{C2}}.$$

In the second period P2, the voltage level at the second node N12 is changed to VD1 from $$VD1\frac{1}{1+\frac{C1}{C2}},$$

such that the voltage level at the first node N11 is effectively coupled to $$VD1+\left(\frac{C2}{C2+CL}\right)\left(VD1-VD1\frac{1}{1+\frac{C1}{C2}}\right)=VD1+VD1\left(\frac{R1}{1+R1}\right)K1\ ,$$

$$\text{wherein } R1=\frac{C1}{C2} \text{ and } K1=\left(\frac{C2}{C2+CL}\right).$$

If the first data voltage has a positive voltage level relative to the common electrode VCOM, the voltage level at the first node N11 in the second period P2 is higher than the voltage level of the first data voltage. If the first data voltage has a negative voltage level relative to the common electrode VCOM, the voltage level at the first node N11 in the second period P2 is lower than the voltage level of the first data voltage. Accordingly, the voltage difference between the two terminals (that is the first node N11 and the common electrode VCOM) of the liquid crystal capacitor CL is increased.

Figure 3:
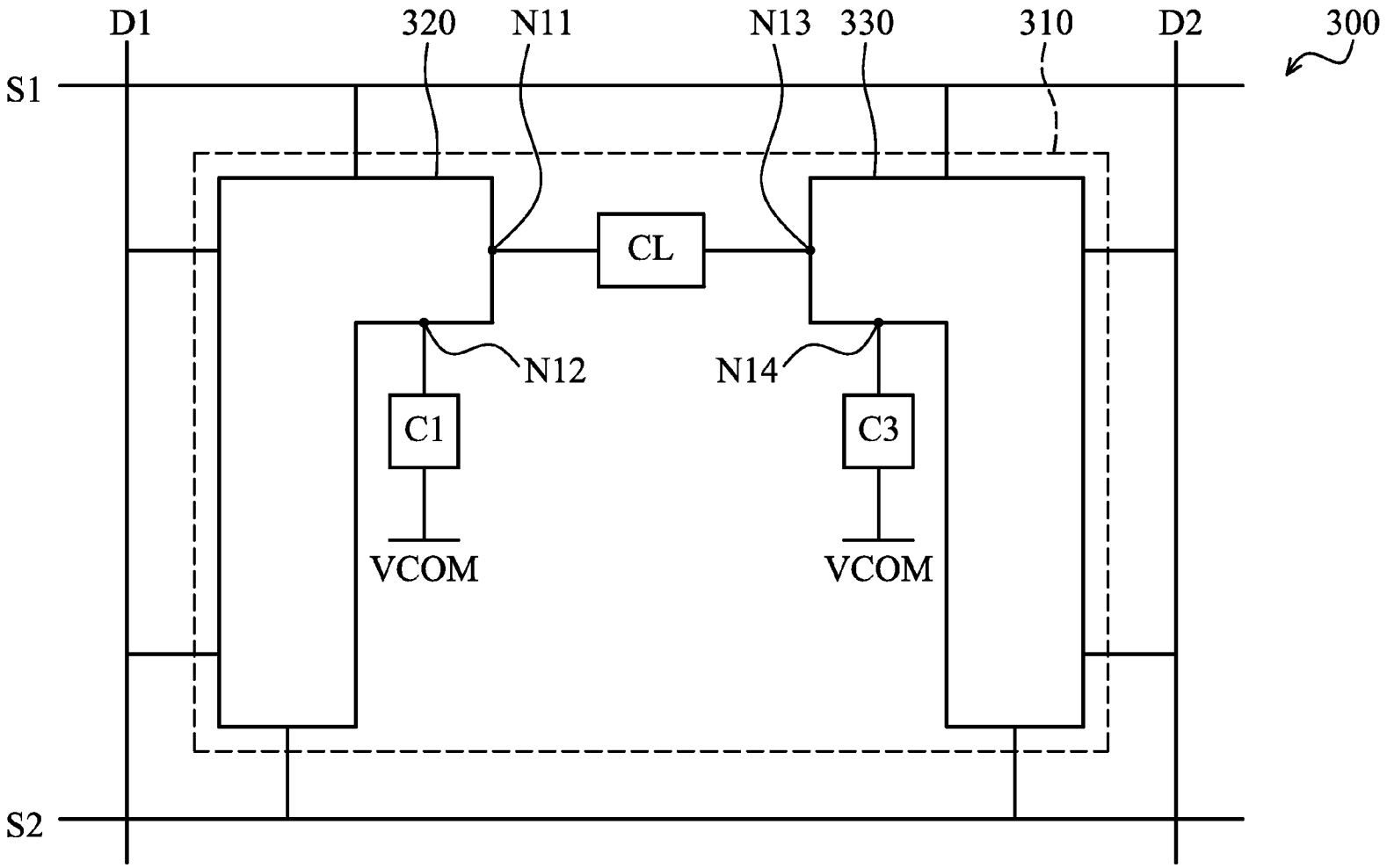
FIG. 3 shows another exemplary embodiment of a display device.

FIG. 3 shows another exemplary embodiment of a display device. As shown in FIG. 3, the display device 300 is similar to the display device 100. The difference between the display devices 300 and 100 is that a pixel driving circuit 310 is coupled to first and second scan signal lines S1 and S2 and first and second data signal lines D1 and D2 and that the polarity of the first data voltage output by the first data signal line D1 is different from the polarity of the second data voltage output by the second data signal line D2. The pixel driving circuit 310 comprises a liquid crystal capacitor CL, storage capacitors C1 and C3, a first voltage control unit 320, and a second voltage control unit 330. In the embodiment, the liquid crystal capacitor CL is a blue phase liquid crystal capacitor. In detail, the liquid crystal capacitor CL is coupled between a first node N11 and a third node N13. The storage capacitor C1 has a first terminal which is directly connected to a second node N12 and a second terminal which is coupled to a common electrode VCOM. The storage capacitor C3 has a first terminal which is directly connected to a second node N14 and a second terminal which is coupled to the common electrode VCOM. Similar to the first voltage control unit 120, the first voltage control unit 320 has a first output terminal and a second output terminal which are coupled to the first node N11 and the second node N14, respectively. The second voltage control unit 330 has a first output terminal and a second output terminal which are coupled to the third node N13 and the fourth node N14, respectively.

In a first period P1, the first voltage control unit 320 and the second voltage control unit 330 feed the first data voltage and the second data voltage to the first node N11 and the third node N13 according to a first scan signal, respectively. In a second period P2 later than the first period P1, the first voltage control unit 320 and the second voltage control unit 330 feed the first data voltage and the second data voltage to the second node N12 and the fourth node N14 according to a second scan signal, respectively, such that the voltage level at the first node N11 is increased to a first pixel voltage from the first data voltage, and the voltage level at the third node N13 is decreased to a second pixel voltage from the second data voltage.

Figure 4:
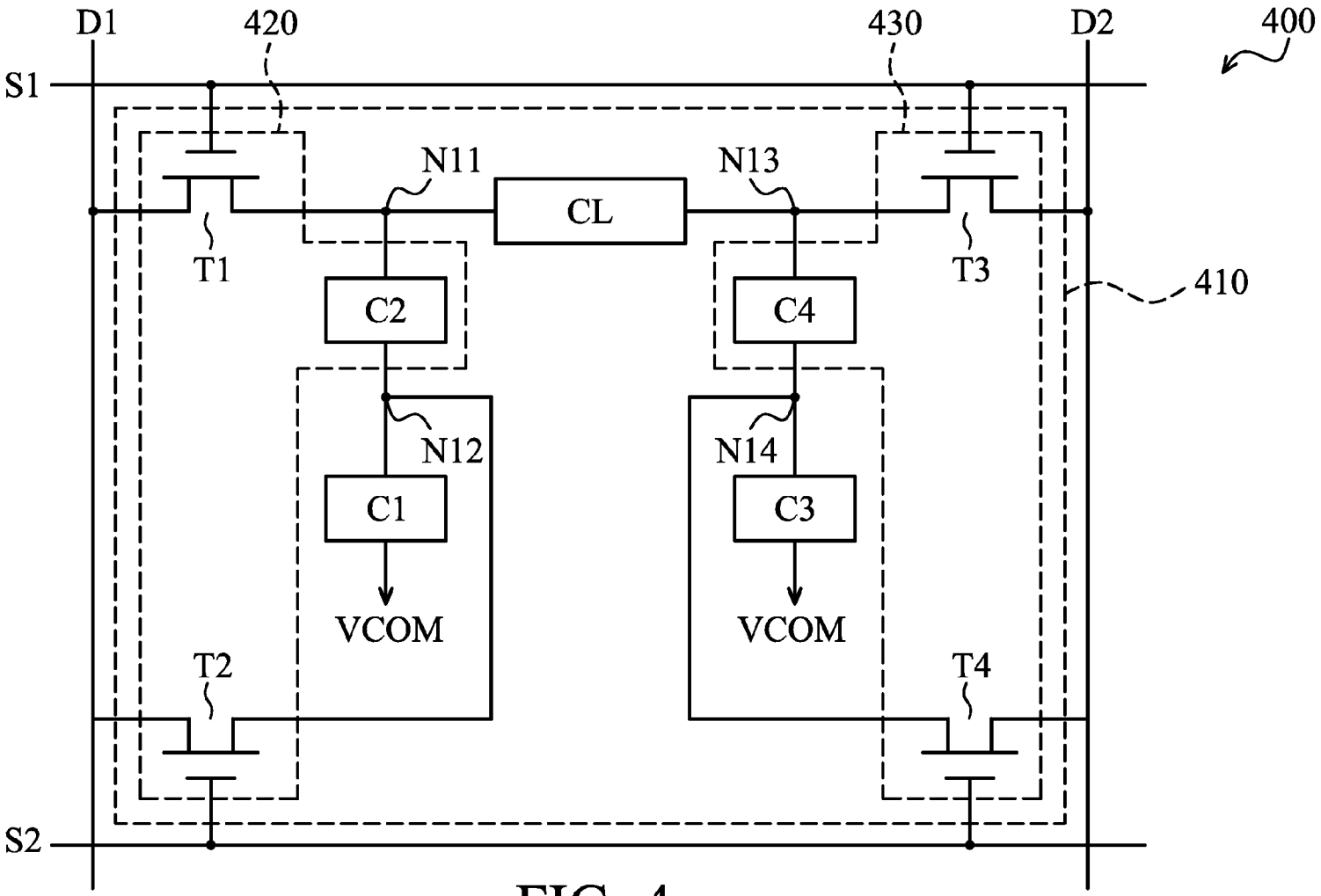
FIG. 4 shows another exemplary embodiment of a pixel driving circuit.

FIG. 4 shows an exemplary embodiment of the pixel driving circuit. As shown in FIG. 4, a display device 400 is the same as the display device 300, wherein a pixel driving circuit 410 comprises a liquid crystal capacitor CL, storage capacitors C1 and C3, a first voltage control unit 420, and a second voltage control unit 430. The liquid crystal capacitor CL is coupled between a first node N11 and a third node N13. The first voltage control unit 420 is the same as the first voltage control unit 120, and, thus, the operation of the first voltage control unit 420 is omitted.

The second voltage control unit 430 comprises switch elements T3 and T4 and a storage capacitor C4. In the embodiment, the switch elements T1-T4 are implemented by N-type thin-film transistors. The switch element T3 comprises a first terminal which is coupled to the third node N13, a second terminal which is coupled to a second data signal line D2 used for outputting a second data voltage, and a control terminal which is coupled to a first scan signal line S1. The switch element T4 comprises a first terminal which is coupled to the a fourth node N14, a second terminal which is coupled to the second data signal line D2, and a control terminal which is coupled to a second scan signal line S2 used for outputting the second scan signal. The storage capacitor C4 is coupled between the third node N13 and the fourth node N14.

In detail, in the first period P1, the switch element T1 and the switch element T3 are turned on according to a first scan signal, while the switch element T2 and the switch element T4 are turned off according to a second scan signal, such that the switch element T1 and the switch element T3 feed a first data voltage and a second data voltage to the first node N11 and the third node N13, respectively. In the second period P2, the switch element T1 and the switch element T3 are turned off according to the first scan signal, while the switch element T2 and the switch element T4 are turned on according to the second scan signal, such that the switch element T2 and the switch element T4 feed the first data voltage and the second data voltage to the second node N12 and the fourth node N14, respectively. Accordingly, the voltage level at the first node N11 and the voltage level at the third node N13 are effectively coupled to a first pixel voltage and a second pixel voltage via the storage capacitor C2 and the storage capacitor C4, respectively.

For example, it is assumed that the voltage level of the first data voltage is VD1 and the voltage level of the second data voltage is VD2. In the first period P1, the voltage level at the first node N11 is VD1. In the second period P2, the voltage level at the first node N11 is effectively coupled to $$VD1+\left(\frac{C2}{C2+CL}\right)\left(VD1-VD1\frac{1}{1+\frac{C1}{C2}}\right)=VD1+VD1\left(\frac{R1}{1+R1}\right)K1\ ,$$

$$\text{wherein } R1=\frac{C1}{C2} \text{ and } K1=\left(\frac{C2}{C2+CL}\right).$$

Similarly, in the first period P1, the voltage level at the third node N13 is VD2. In the second period P2, the voltage level at the third node N13 is effectively coupled $$\text{to } VD2+\left(\frac{C4}{C4+CL}\right)\left(VD2-VD2\frac{1}{1+\frac{C3}{C4}}\right)=VD2+VD2\left(\frac{R2}{1+R2}\right)K2\ ,$$

$$\text{wherein } R2=\frac{C3}{C4} \text{ and } K2=\left(\frac{C4}{C4+CL}\right).$$

In the embodiment, the first data voltage has a positive voltage level relative to the common electrode VCOM, and the second data voltage has a negative voltage level relative to the common electrode VCOM. Thus, in the second period P2, the voltage level at the first node N11 is higher than the voltage level of the first data voltage, and the voltage level at the third node N13 is higher than the voltage level of the second data voltage. Accordingly, the voltage difference between the two terminals (that is the first node N11 and the third node N13) of the liquid crystal capacitor CL is increased.

Figure 5:
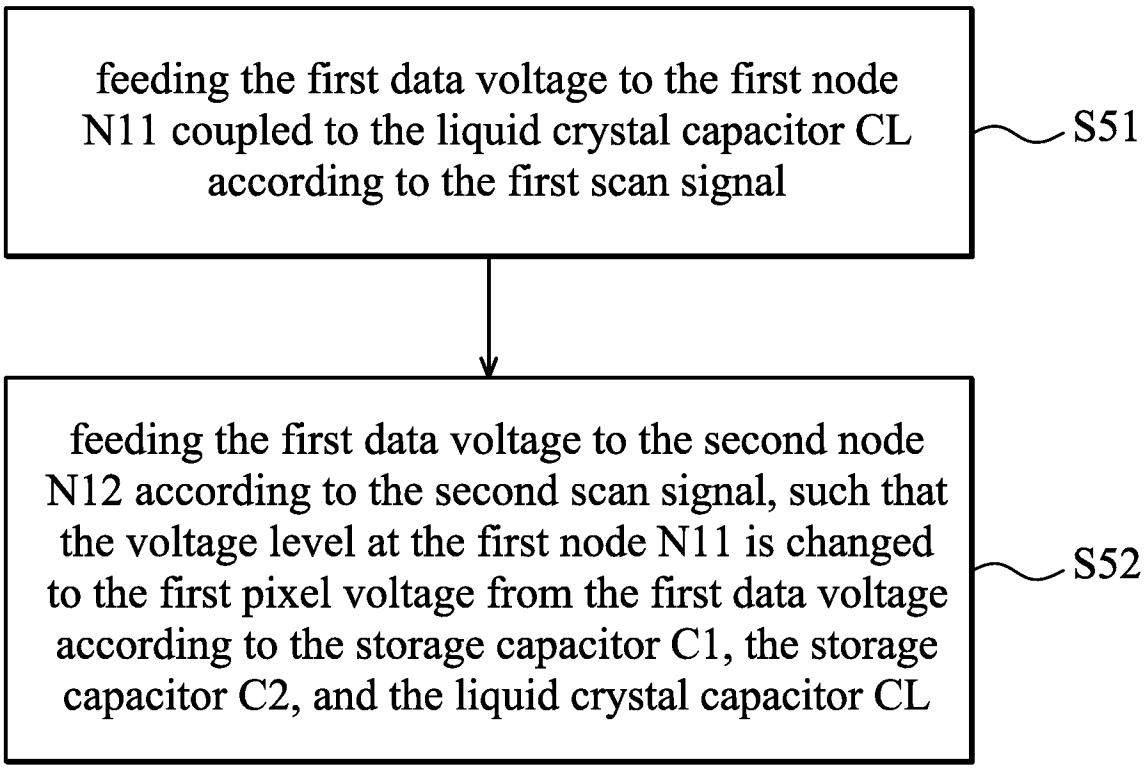
FIG. 5 is a flow chart of an exemplary embodiment of a pixel driving method.

FIG. 5 is a flow chart of an exemplary embodiment of a pixel driving method applied to the pixel driving circuits 110, 210, 310, and 410. As shown in FIG. 5, in the first period P1, the pixel driving method proceeds to step S51. In step S51, the first data voltage is fed to the first node N11 coupled to the liquid crystal capacitor CL according to the first scan signal, wherein the storage capacitor C1 is directly connected between the second node N12 and the common electrode VCOM, while the storage capacitor C2 is directly connected between the first node N11 and the second node N12.

In the second period P2 later than the first period P1, the pixel driving method proceeds to a step S52. In step S52, the first data voltage is fed to the second node N12 according to the second scan signal, such that the voltage level at the first node N11 is changed to the first pixel voltage from the first data voltage according to the storage capacitor C1, the storage capacitor C2, and the liquid crystal capacitor CL.

Moreover, when the pixel driving method is applied to the pixel driving circuits 310 and 410, the step S51 further comprises feeding the first data voltage to the third node N13 coupled to the liquid crystal capacitor CL according to the first scan signal, wherein the storage capacitor C3 is directly connected between the fourth node N14 and the common electrode VCOM, while the storage capacitor C4 is directly connected between the third node N13 and the fourth node N14.

The step S52 further comprises feeding the first data voltage to the third node N14 according to the second scan signal, such that the voltage level at the third node N13 is changed to the second pixel voltage from the second data voltage according to the storage capacitor C3, the storage capacitor C4, and the liquid crystal capacitor CL.

Figure 6:
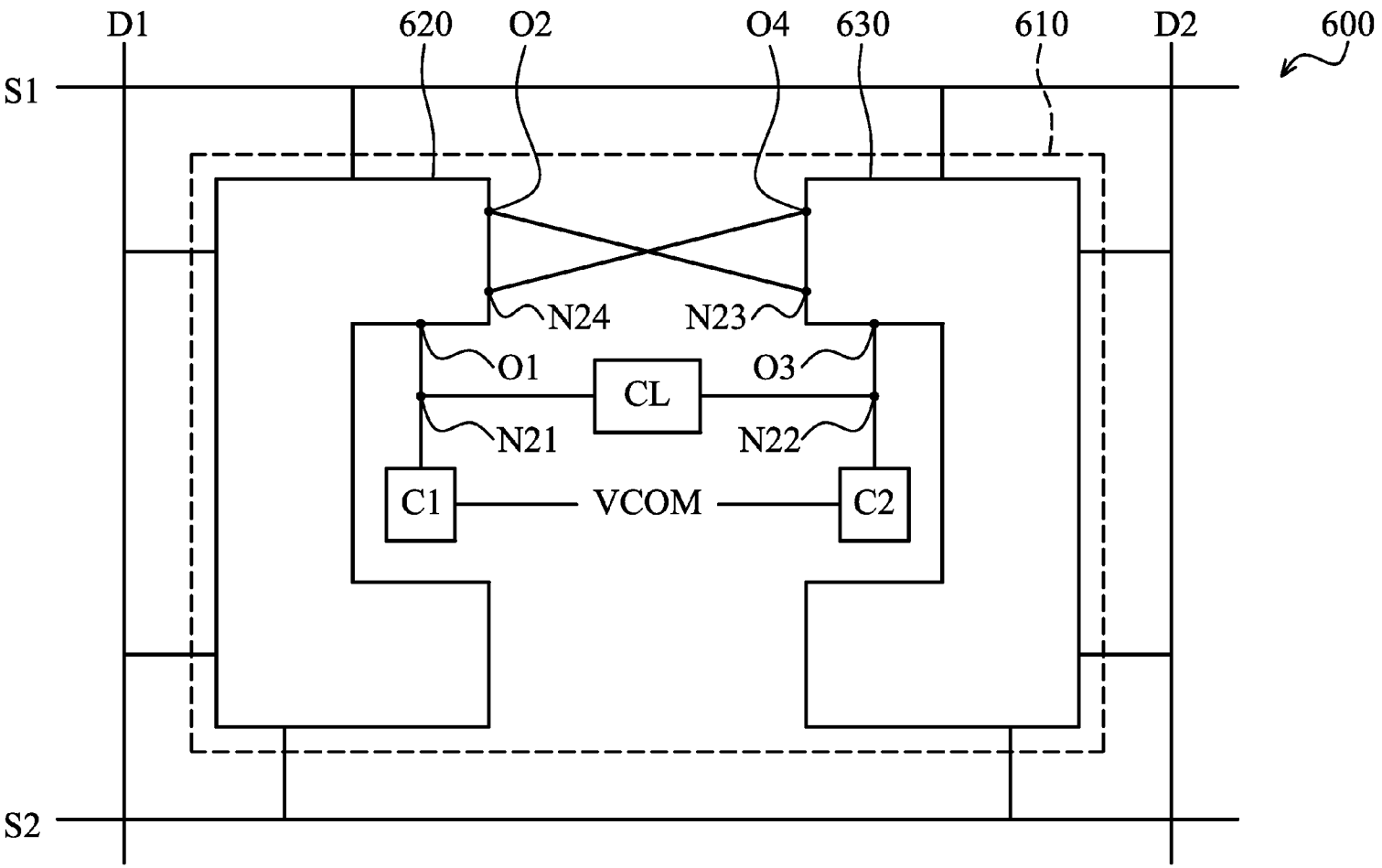
FIG. 6 shows yet another exemplary embodiment of a display device.

FIG. 6 shows yet another exemplary embodiment of a display device. As shown in FIG. 6, a display device 600 comprises a pixel driving circuit 610 coupled to the data signal lines D1 and D2 and scan signal lines S1 and S2. The pixel driving circuit 610 comprises a liquid crystal capacitor CL, storage capacitors C1 and C2, and voltage control units 620 and 630. The liquid crystal capacitor CL is coupled between a first node N21 and a second node N22. The storage capacitor C1 has a first terminal which is directly connected to the first node N21 and a second terminal which is coupled to a common electrode VCOM. The storage capacitor C2 has a first terminal which is directly connected to the second node N22 and a second terminal which is coupled to the common electrode VCOM. The voltage control unit 620 has an output terminal O1 and an output terminal Q2 which are coupled to the first node N21 and a third node N23, respectively. The voltage control unit 630 has an output terminal O3 and an output terminal O4 which are coupled to the second node N22 and a fourth node N24, respectively.

In a first period P1, the voltage control unit 620 feeds a first data voltage to the first node N21 and the third node N23 according to a first scan signal, and the voltage control unit 630 feeds a second data voltage to the second node N22 and the fourth node N24 according to the first scan signal. In a second period P2 later than the first period P1, the voltage control unit 620 and the voltage control unit 630 feed the first data voltage and the second data voltage to the fourth node N24 and the third node N23 according to a second scan signal, respectively, such that the voltage level at the first node N21 is charged to a first pixel voltage from the first data voltage, and the voltage level at the second node N22 is charged to a second pixel voltage from the second data voltage.

Figure 7:
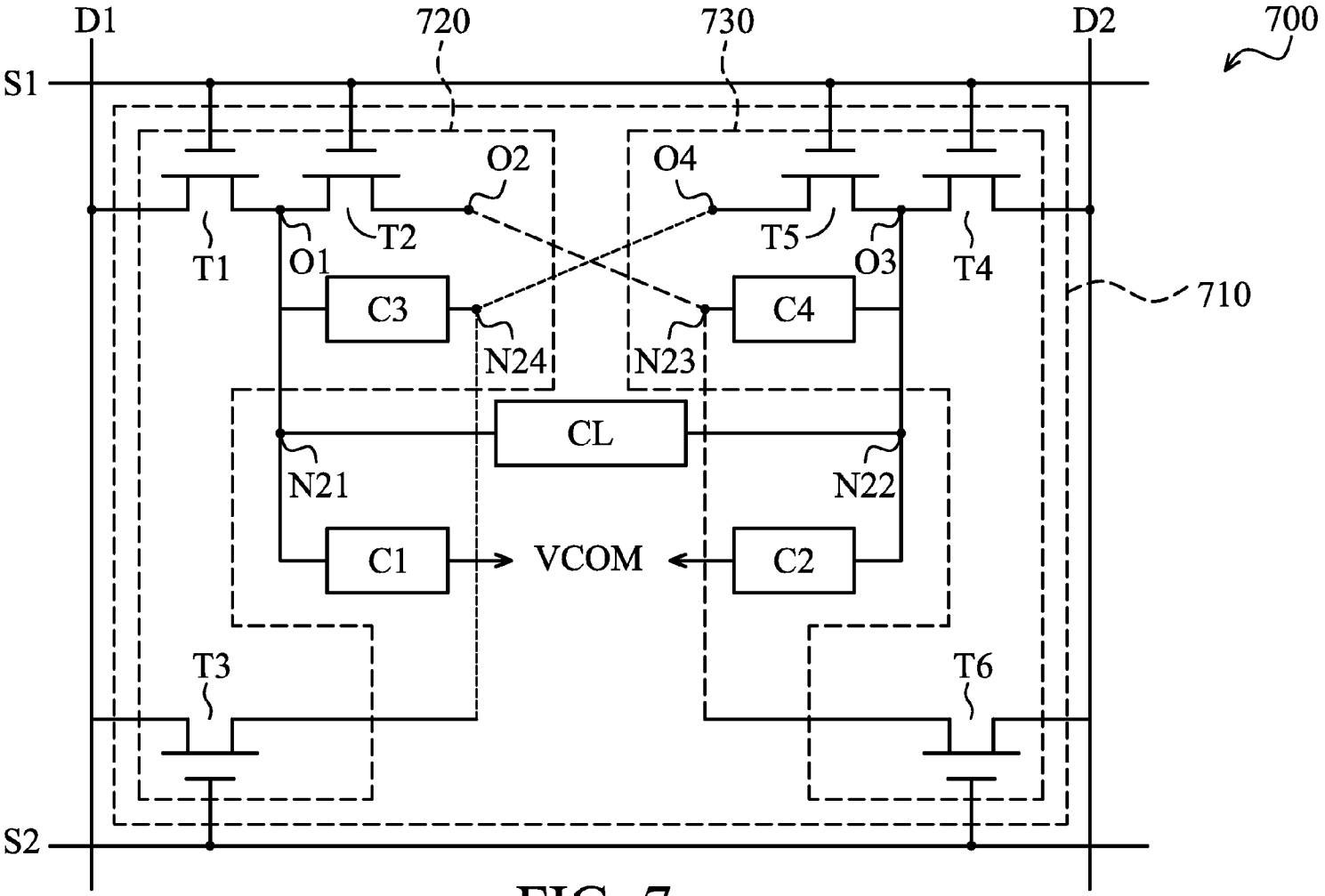
FIG. 7 shows yet another exemplary embodiment of a pixel-driving circuit.

FIG. 7 shows an exemplary embodiment of the pixel driving circuit. As shown in FIG. 7, a display device 700 is the same as the display device 600, wherein a pixel driving circuit 710 comprises a liquid crystal capacitor CL, storage capacitors C1 and C2, and voltage control units 720 and 730. The voltage control units 720 and 730 are the same as the voltage control units 620 and 630, respectively. The voltage control unit 720 comprises switch elements T1, T2, and T3 and a storage capacitor C3. The switch element T1 comprises a first terminal which is coupled to a first node N21, a second terminal which is coupled to a first data signal line D1 used for outputting a first data voltage, and a control terminal which is coupled to a first scan signal line S1 used for outputting a first scan signal. The switch element T2 comprises a first terminal which is coupled to a third node N23, a second terminal which is coupled to the first node N21, and a control terminal which is coupled to the first scan signal line S1. The switch element T3 comprises a first terminal which is coupled to a fourth node N24, a second terminal which is coupled to the first data signal line D1, and a control terminal which is coupled to a second scan signal line S2 used for outputting a second scan signal. The storage capacitor C3 is coupled between the first node N21 and the fourth node N24.

The voltage control unit 730 comprises switch elements T4, T5, and T6 and a storage capacitor C4. The switch element T4 comprises a first terminal which is coupled to a second node N22, a second terminal which is coupled to a second data signal line D2 used for outputting a second data voltage, and a control terminal which is coupled to the first scan signal line S1. The switch element T5 comprises a first terminal which is coupled to the fourth node N24, a second terminal which is coupled to the second node N22, and a control terminal which is coupled to the first scan signal line S1. The switch element T6 comprises a first terminal which is coupled to the third node N23, a second terminal which is coupled to the second data signal line D2, and a control terminal which is coupled to the second scan signal line S2. The storage capacitor C4 is coupled between the third node N23 and the second node N22.

In detail, in the first period P1, the switch elements T1, T2, T4, and T5 are turned on according to the first scan signal, while the switch elements T3 and T6 are turned off according to the second scan signal, such that the switch elements T1 and T2 feed the first data voltage to the first node N21 and the third node N23, and the switch elements T4 and T5 feed the second data voltage to the second node N22 and the fourth node N24.

In the second period P2, the switch elements T1, T2, T3, and T4 are turned off according to the first scan signal, while the switch elements T3 and T6 are turned on according to the second scan signal, such that the switch element T3 and the switch element T6 feed the first data voltage and the second data voltage to the fourth node N24 and the third node N23, respectively. Accordingly, the voltage level at the first node N21 and the voltage level at the second node N22 are effectively coupled a first pixel voltage and a second pixel voltage via the storage capacitor C3 and the storage capacitor C4, respectively.

For example, it is assumed that the voltage level of the first data voltage is VD1 and the voltage level of the second data voltage is VD2. In the first period P1, the voltage level at the first node N21 is VD1, and the voltage level at the fourth node N24 is VD2. In the second period P2, the voltage level at the fourth node N24 is changed to VD1 from VD2, such that the voltage level at the first node N21 is effectively coupled to VD1+K3(VD1−VD2), wherein $$K3 = \left(\frac{C3}{C3 + CL}\right).$$

Similarly, in the first period P1, the voltage level at the second node N22 is VD2, and the voltage level at the third node N23 is VD1. In the second period P2, the voltage level at the third node N23 is changed to VD2 from VD1, such that the voltage level at the second node N22 is effectively coupled to VD2+K4(VD2−VD1), wherein $$K4 = \left(\frac{C4}{C4 + CL}\right).$$

In the embodiment, the first data voltage has a positive voltage level relative to the common electrode VCOM, and the second data voltage has a negative voltage level relative to the common electrode VCOM. Thus, the voltage difference between the first node N21 and the second node N22 is increased to (VD1−VD2)+(K3+K4)(VD1−VD2) from (VD1−VD2), such that the voltage difference between the two terminals of the liquid crystal capacitor CL is increased.

Figure 8:
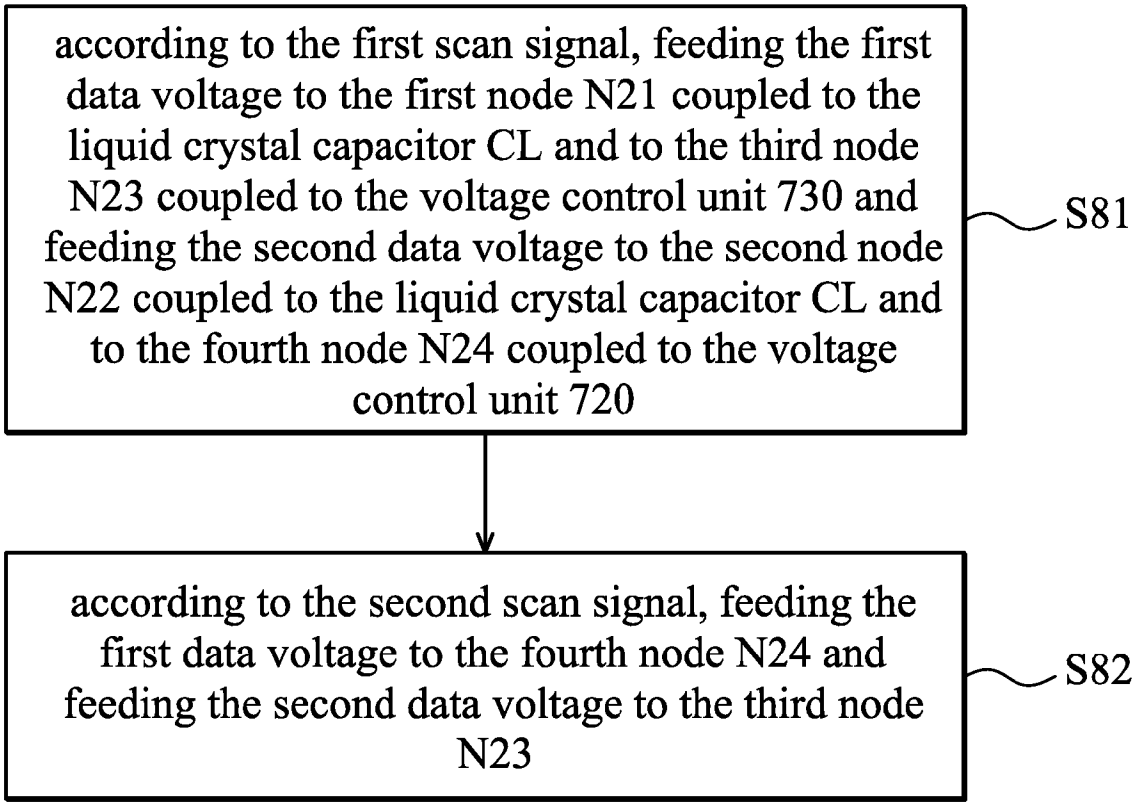
FIG. 8 is a flow chart of another exemplary embodiment of a pixel driving method.

FIG. 8 is a flow chart of another exemplary embodiment of a pixel driving method applied to the pixel driving circuits 610 and 710.

In the first period P1, the pixel driving method proceeds to a step S81. At the step S81, according to the first scan signal, the first data voltage is fed to the first node N21 coupled to the liquid crystal capacitor CL and to the third node N23 coupled to the voltage control unit 730 and the second data voltage is fed to the second node N22 coupled to the liquid crystal capacitor CL and to the fourth node N24 coupled to the voltage control unit 720, wherein the storage capacitor C1 is directly connected between the first node N21 and the common electrode VCOM, and the storage capacitor C2 is directly connected between the second node N22 and the common electrode VCOM.

In the second period P2 later than the first period P1, the pixel driving method proceeds to a step S82. In the step S82, according to the second scan signal, the first data voltage is fed to the fourth node N24, and the second data voltage is fed to the third node N23, such that the voltage level at the first node N21 is increased to the first pixel voltage from the first data voltage, and the voltage level at the second node N22 is increased to the second pixel voltage from the second data voltage. Accordingly, the voltage difference between the two terminals of the liquid crystal capacitor CL is increased, thereby shortening the response time of the liquid crystal molecules.

Figure 9:
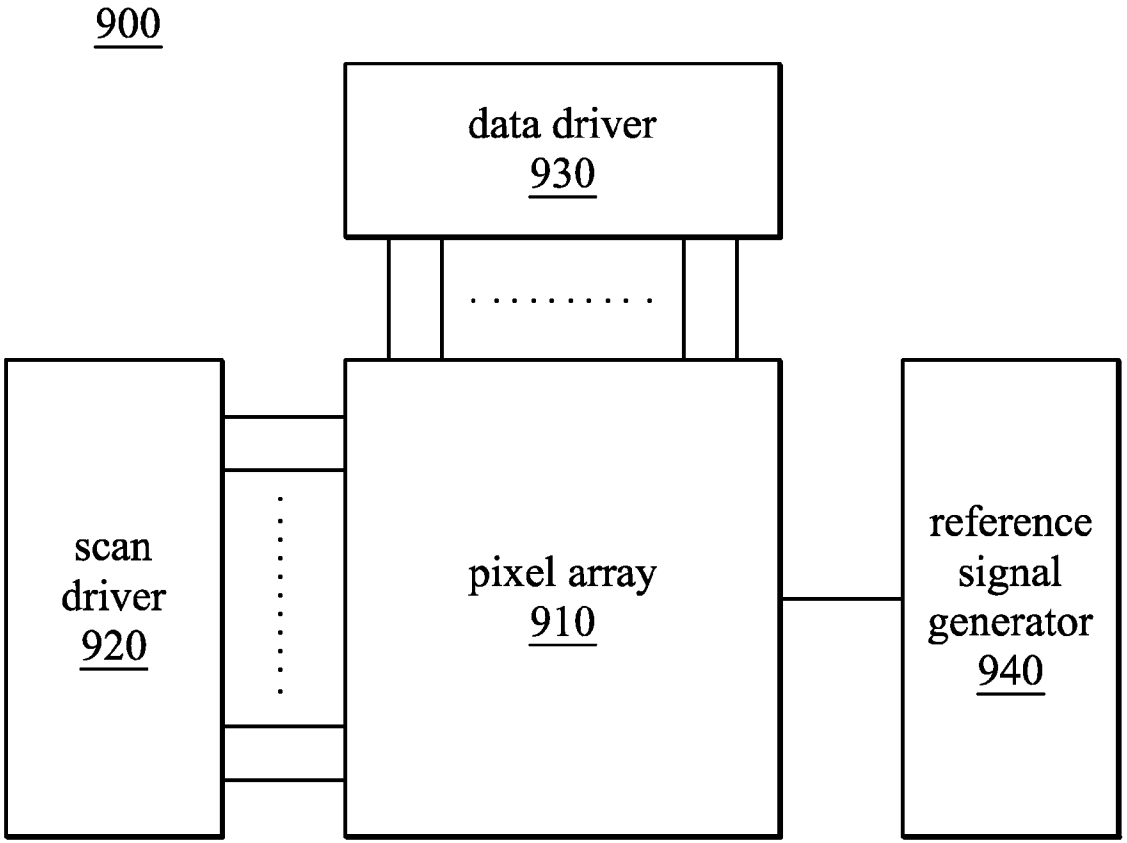
FIG. 9 shows an exemplary embodiment of a display panel.

FIG. 9 shows an exemplary embodiment of a display panel. As shown in FIG. 9, a display panel (also referred as display device) 900 comprises a pixel array 910, a scan driver 920, a data driver 930, and a reference signal generator 940. For example, the pixel array 910 comprises a plurality of pixels. Each pixel comprises the pixel driving circuit 110, 210, 310, 410, 610, or 710.

The scan driver 910 is arranged to provide scan signals (such as the first scan signal and the second scan signal) to the pixel array 910, such that the scan signal lines are driven or disabled. The data driver 930 is arranged to provide the data voltages to the pixel driving circuit 110 (or the pixel driving circuit 210, 310, 410, 510, 610, or 710) of the pixel array 910. The reference signal generator 940 is arranged to provides reference signal(s) to the pixel driving circuit 110 (or the pixel driving circuit 210, 310, 410, 510, 610, or 710) of the pixel array 910. In an embodiment, the reference signal generator 940 may be integrated into the scan driver 920.

Moreover, when the pixel array 910 comprises the pixel driving circuit 210 of FIG. 2, each pixel row of the pixel array 910 comprises two different scan signal lines to transmit the first scan signal and the second scan signal to the pixel driving circuit 210, respectively. When the pixel array 910 comprises the pixel driving circuit 410 of FIG. 4 or the pixel driving circuit 710 of FIG. 7, each pixel row of the pixel array 910 comprises the two scan signal lines S1 and S2, and each pixel column of the pixel array 910 comprises the two data signal lines D1 and D2.

Figure 10:
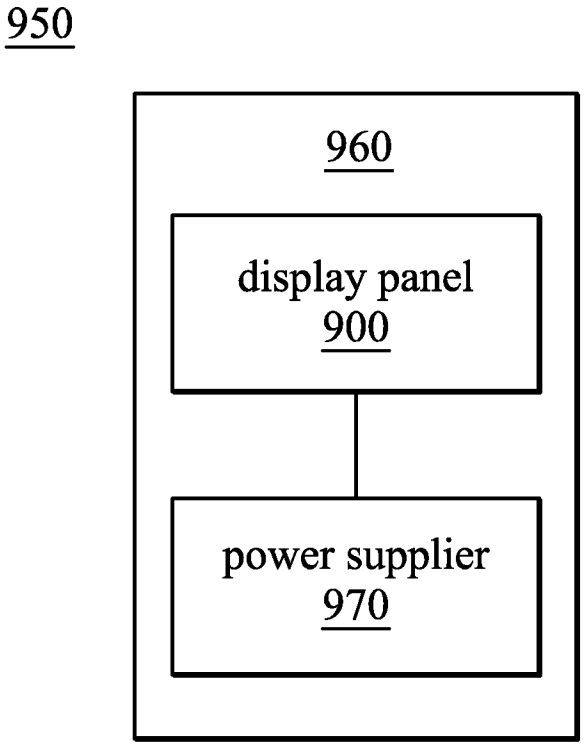
FIG. 10 shows an exemplary embodiment of an electronic device.

FIG. 10 shows an exemplary embodiment of an electronic device. As shown in FIG. 10, the electronic device 950 uses the display panel 900 of FIG. 9. For example, the electronic device 950 may be a portable device such as a PDA (personal digital assistant), a notebook computer, a tablet computer, a cellular phone, a displayer, or any similar device.

Generally, the electronic device 950 comprises a case 960, a display panel 900, and a power supplier 970. The electronic device 950 further comprises other elements, however, and the related operation is omitted. Regarding operations, the power supplier 970 is arranged to provide power to the display panel 900, such that the display panel can operate to display images.

As described above, the pixel driving circuit 110, 210, 310, 410, 610, or 710 in the above embodiments can increase the voltage difference of the liquid crystal capacitor CL, such that the voltage difference between the first pixel voltage and the second pixel voltage is larger than the voltage difference between the first data voltage and the second data voltage, thereby shortening the response time of the liquid crystal molecules.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A display device comprising:

a pixel driving circuit comprises:

a liquid crystal capacitor coupled to a first node;

a first storage capacitor having a first terminal directly connected to a second node and a second terminal coupled to a common electrode; and a first voltage control unit having a first output terminal and a second output terminal coupled to the first node and the second node, respectively, wherein, in a first period, the first voltage control unit feeds a first data voltage to the first node according to a first scan signal, and in a second period later than the first period, the first voltage control unit feeds the first data voltage to the second node according to a second scan signal, such that a voltage level at the first node is changed to a first pixel voltage from the first data voltage.

2. The display device as claimed in claim 1, wherein the first voltage control unit comprises:

a first switch element having a first terminal coupled to the first node, a second terminal coupled to a first data signal line outputting the first data voltage, and a control terminal coupled to a first scan signal line outputting the first scan signal;

a second switch element having a first terminal coupled to the second node, a second terminal coupled to the first data signal line, and a control terminal coupled to a second scan signal line outputting the second scan signal; and a second storage capacitor coupled between the first node and the second node.

3. The display device as claimed in claim 2, wherein the liquid crystal capacitor is coupled between the first node and the common electrode.

4. The display device as claimed in claim 1, wherein the liquid crystal capacitor is coupled between the first node and a third node, wherein the display device further comprises:

a third storage capacitor having a first terminal directly connected to a fourth node and a second terminal coupled to the common electrode; and a second voltage control unit has a first output terminal and a second output terminal coupled to the third node and the fourth node, respectively, wherein in the first period, the first voltage control unit and the second voltage control unit feed the first data voltage and a second data voltage to the first node and the third node, respectively, according to the first scan signal, and in the second period, the first voltage control unit and the second voltage control unit feed the first data voltage and the second data voltage to the second node and the fourth node, respectively, according to the second scan signal, such that the voltage level at the first node is changed to the first pixel voltage from the first data voltage, and a voltage level at the third node is changed to a second pixel voltage from the second data voltage.

5. The display device as claimed in claim 4, wherein the first voltage control unit comprises:

a first switch element having a first terminal coupled to the first node, a second terminal coupled to a first data signal line outputting the first data voltage, and a control terminal coupled to a first scan signal line outputting the first scan signal;

a second switch element having a first terminal coupled to the second node, a second terminal coupled to the first data signal line, and a control terminal coupled to a second scan signal line outputting the second scan signal; and a second storage capacitor coupled between the first node and the second node.

6. The display device as claimed in claim 5, wherein the second voltage control unit comprises:

a third switch element having a first terminal coupled to the third node, a second terminal coupled to a second data signal line outputting the second data voltage, and a control terminal coupled to the first scan signal line;

a fourth switch element having a first terminal coupled to the fourth node, a second terminal coupled to the second data signal line, and a control terminal coupled to the second scan signal line; and a fourth storage capacitor coupled between the third node and the fourth node.

7. The display device as claimed in claim 6, wherein in the first period, the first switch element and the third switch element are turned on according to the first scan signal, and the second switch element and the fourth switch element are turned off according to the second scan signal, such that the first switch element and the third switch element feed the first data voltage and the second data voltage to the first node and the third node, respectively.

8. The display device as claimed in claim 6, wherein in the second period, the first switch element and the third switch element are turned off according to the first scan signal, and the second switch element and the fourth switch element are turned on according to the second scan signal, such that the second switch element and the fourth switch element feed the first data voltage and the second data voltage to the second node and the fourth node, respectively, to couple the voltage level at the first node and the voltage level at the third node to the first pixel voltage and the second pixel voltage via the second storage capacitor and the fourth storage capacitor, respectively.

9. The display device as claimed in claim 4, wherein the liquid crystal capacitor is a blue phase liquid crystal capacitor, and the polarity of the first data voltage is different from the polarity of the second data voltage.

10. A pixel driving method for a pixel driving circuit of a display device, comprising:

in a first period, feeding a first data voltage to a first node, which is coupled to a liquid crystal capacitor, according to a first scan signal, wherein a first storage capacitor is directly connected between a second node and a common electrode, and a second storage capacitor is directly connected between the first node and the second node;

in the first period, feeding a second data voltage to a third node, which is coupled to the liquid crystal capacitor, according to the first scan signal, wherein a third storage capacitor is directly connected between a fourth node and a common electrode, and a fourth storage capacitor is directly connected between the third node and the fourth node;

in a second period later than the first period, feeding the first data voltage to the second node according to a second scan signal, such that a voltage level at the first node is coupled to a first pixel voltage from the first data voltage by the first storage capacitor, the second storage capacitor, and the liquid crystal capacitor; and in the second period, feeding the second data voltage to the fourth node according to the second scan signal, such that a voltage level at the third node is coupled to a second pixel voltage from the second data voltage by the third storage capacitor, the fourth storage capacitor, and the liquid crystal capacitor.

11. The pixel driving method as claimed in claim 10, wherein the liquid crystal capacitor is a blue phase liquid crystal capacitor, and the polarity of the first data voltage is different from the polarity of the second data voltage.

12. A display device comprising:

a pixel driving circuit comprises:

a liquid crystal capacitor coupled between a first node and a second node;

a first storage capacitor having a first terminal directly connected to the first node and a second terminal coupled to a common electrode;

a second storage capacitor having a first terminal directly connected to the second node and a second terminal coupled to the common electrode;

a first voltage control unit having a first output terminal and a second output terminal coupled to the first node and a third node, respectively; and a second voltage control unit having a first output terminal and a second output terminal coupled to the second node and a fourth node, respectively wherein, in a first period, the first voltage control unit feeds a first data voltage to the first node and the third node according to a first scan signal, and the second voltage control unit feeds a second data voltage to the second node and the fourth node according to the first scan signal, and wherein in a second period later than the first period, the first voltage control unit and the second voltage control unit feed the first data voltage and the second data voltage to the fourth node and third node, respectively, according to a second scan signal such that a voltage level at the first node is increased to a first pixel voltage from the first data voltage, and a voltage level at the second node is decreased to a second pixel voltage from the second data voltage.

13. The display device as claimed in claim 12, wherein the first voltage control unit comprises:

a first switch element having a first terminal coupled to the first node, a second terminal coupled to a first data signal line outputting the first data voltage, and a control terminal coupled to a first scan signal line outputting the first scan signal;

a second switch element having a first terminal coupled to the third node, a second terminal coupled to the first node, and a control terminal coupled to the first scan signal line;

a third switch element having a first terminal coupled to the fourth node, a second terminal coupled to the first data signal line, and a control terminal coupled to a second scan signal line outputting the second scan signal; and a third storage capacitor coupled between the first node and the fourth node.

14. The display device as claimed in claim 13, wherein the second voltage control unit comprises:

a fourth switch element having a first terminal coupled to the second node, a second terminal coupled to a second data signal line outputting the second data voltage, and a control terminal coupled to the first scan signal line;

a fifth switch element having a first terminal coupled to the fourth node, a second terminal coupled to the second node, and a control terminal coupled to the first scan signal line;

a sixth switch element having a first terminal coupled to the third node, a second terminal coupled to the second data signal line, and a control terminal coupled to the second scan signal line; and a fourth storage capacitor coupled between the third node and the second node.

15. The display device as claimed in claim 14, wherein in the first period, the first switch element, the second switch element, the fourth switch element, and the fifth switch element are turned on according to the first scan signal, and the third switch element and the sixth switch element are turned off according to the second scan signal, such that the first switch element and the second switch element feed the first data voltage to the first node and the third node, and the fourth switch element and the fifth switch element feed the second data voltage to the second node and the fourth node.

16. The display device as claimed in claim 14, wherein in the second period, the first switch element, the second switch element, the fourth switch element, and the fifth switch element are turned off according to the first scan signal, and the third switch element and the sixth switch element are turned on according to the second scan signal, such that the third switch element and the sixth switch element feed the first data voltage and the second data voltage to the fourth node and the third node to couple the voltage level at the first node and the voltage level at the second node to the first pixel voltage and the second pixel voltage, respectively.

17. The display device as claimed in claim 12, wherein the liquid crystal capacitor is a blue phase liquid crystal capacitor, and the polarity of the first data voltage is different from the polarity of the second data voltage.

* * * * *